US005160105A

United States Patent [19]

Miller

[11] Patent Number: 5,160,105

[45] Date of Patent: Nov. 3, 1992

[54] PROTECTIVE FOOT DEVICE FOR MOUNTING ON FURNITURE

[75] Inventor: Robert H. Miller, Schaumburg, Ill.

[73] Assignee: Nu-Zip Dee Mfg., Inc., Elk Grove Village, Ill.

[21] Appl. No.: 690,374

[22] Filed: Apr. 23, 1991

Related U.S. Application Data

[63] Continuation-in-part of Ser. No. 506,440, Apr. 6, 1990, abandoned, which is a continuation-in-part of Ser. No. 418,745, Oct. 3, 1989, abandoned, which is a continuation of Ser. No. 196,304, May 20, 1988, abandoned.

[51] Int. Cl.[5] ..... A47B 91/00

[52] U.S. Cl. ..... 248/188.9; 248/345.1; 248/231.8

[58] Field of Search ..... 248/188.9, 231.8, 230, 248/345.1, 346, 359.1, 74.2; 312/140; 24/564, 555, 561, 562, 556; 297/239

[56] References Cited

U.S. PATENT DOCUMENTS

| | | | |
|---|---|---|---|
| 1,804,841 | 5/1931 | Peedroli | 248/345.1 |
| 1,973,226 | 9/1934 | Rose et al. | 248/188.9 X |
| 1,988,860 | 1/1935 | Smith | 248/188.9 X |
| 2,736,130 | 2/1956 | Boiu | 248/188.9 |
| 2,750,769 | 6/1956 | Yost et al. | 248/362 X |
| 2,829,937 | 5/1958 | Jones et al. | 248/188.9 |
| 2,875,552 | 3/1959 | Stillman | 248/188.9 |
| 2,888,775 | 6/1959 | Thoeming | 248/188.9 |
| 3,254,362 | 6/1966 | Rasor et al. | 248/188.8 X |
| 3,365,233 | 1/1968 | Uyeda et al. | 297/239 |
| 3,606,218 | 9/1971 | Enlund et al. | 248/74.2 |
| 3,669,490 | 6/1972 | Bertolet | 248/345.1 X |
| 3,762,108 | 10/1973 | Pierson | 24/555 X |
| 3,826,453 | 7/1974 | Hitchcock | 297/248 |
| 3,978,610 | 9/1976 | Stubbmann | 248/231.8 X |
| 4,041,881 | 8/1977 | Textoris et al. | 248/188.1 X |
| 4,320,832 | 3/1982 | Edstrom | 248/230 X |
| 4,330,148 | 5/1982 | La Mont | 24/561 X |
| 4,338,875 | 7/1982 | Lisowski | 248/230 X |
| 4,501,201 | 2/1985 | Fitzner et al. | 248/230 X |
| 4,564,237 | 1/1986 | Steifensand | 248/188.8 X |
| 4,763,390 | 8/1988 | Rooz | 24/562 |

*Primary Examiner*—Karen J. Chotkowski
*Attorney, Agent, or Firm*—Emrich & Dithmar

[57] ABSTRACT

A protective foot device for mounting on a piece of furniture to prevent movement of the furniture, such as the base, and to minimize marring of the floor or the furniture base is disclosed. The foot device has a portion that includes both an inner surface and an outside surface. The outside surface comes in contact with the floor, and the inside surface can have a plurality of longitudinal strips, which include longitudinal strip contact surfaces to contact and grip the furniture. The device also has end sections to permit the mounting and the removal of the device on the furniture and to prohibit excess rotation of the device.

20 Claims, 2 Drawing Sheets

PROTECTIVE FOOT DEVICE FOR MOUNTING ON FURNITURE

CROSS-REFERENCES TO RELATED APPLICATIONS

This is a continuation in part of pending application Ser. No. 506,440, filed Apr. 6, 1990, which was a continuation in part application Ser. No. 07/418,745 filed Oct. 3, 1989, which is a continuation of application Ser. No. 07/196,304 filed May 20, 1988, all now abandoned.

BACKGROUND OF THE INVENTION

The present invention relates in general to an apparatus adapted to be mounted on furniture, including the stand or the base of a piece of furniture which comes in contact with the floor or a similar supporting surface. In particular, the present invention comprises a unitary protective foot device for axially mounting on a floor contacting member of a piece of furniture. The foot device is adapted to fit snugly on a variety of contacting members and to remain secure on said members, without the use of tools, fasteners or separate fastening mechanisms. Further, the design is easy to mount and to remove from a contacting member. Additionally, it is strong enough to support a piece of furniture, can restrict creeping or moving of the furniture, and does not mar the integrity of the floor or the supporting surface on which the furniture is placed. Further still, the device can protect the integrity of the contacting member from abrasion or destruction.

On certain types of furniture, which may include tables, chairs, or any utilitarian device wherein a member of the framing is parallel with the ground and serves as a leg on which the furniture rests, it is often desirable to interpose a substance or pad between the leg member and the ground to prevent direct contact. The purpose of this pad may be to preserve the original surface of either the ground or the member or to either prevent furniture from shifting or moving or to, conversely, aid in easy movement. In furniture that has legs or feet positioned vertically to the ground, this usually takes the shape of cups that can be slipped over the ends of the legs or glides or pads that are nailed, riveted, or screwed into the ends of the legs. Glides are most commonly used for easy movement of the furniture; soft cups or pads are typically used to prevent movement.

The use of a protective foot, pad or bumper to prevent items, such as furniture having a horizontal floor contacting member, from scuffing, scraping, scratching, or marring the floor or the furniture's base is well recognized. Devices for this purpose are discussed in U.S. Pat. Nos. 4,648,653, 3,404,916, 3,826,453, 3,365,233, and 1,988,860.

In the case of horizontal floor contacting members, these prior art protective pads or feet usually take the form of a hard or soft pad that must be permanently or semi-permanently attached to the horizontal member by either an adhesive, screw, rivet, nail or other similar interlocking member (i.e. U.S. Pat. No. 3,724,897), In most cases, it is necessary to prepare the receiving leg with a hole, dimple indentation (or roughing of the surface in the case of adhesive) into which fastening device (screw, rivet, nail or projection from the foot member itself) is inserted. Usually the preparation of the horizontal leg member is designed to mate with a particular shape connection (i.e. U.S. Pat. Nos. 2,888,775 and 4,041,881). That often means that each manufacturer has its own shape of foot and leg preparation so that the pads cannot be interchanged between the furniture legs of different manufacturers. It also means that should a foot or protective pad become broken, replacement is often extremely difficult since the user must go to that specific manufacturer to obtain replacement parts. Such replacements, by the very nature of the parts, can also be complicated, cumbersome and sometimes destructive. No generic replacement protective feet are available to the end user.

SUMMARY OF THE INVENTION

The protective generic or universal foot device of the present invention is a unitary apparatus that is axially mounted on a floor contacting member of a piece of furniture to, among other things, prevent such member from marring the integrity of the floor or the supporting surface. The device has a body portion with an inside diameter equal to or slightly larger than the outside diameter of the furniture floor contacting member, one or two longitudinal strips, and end sections. The device holds its position to the floor contacting member by friction rather than by using any designed slot, aperture, etc. attaching means of the furniture. Specifically, the device is mounted onto a floor contacting member by pushing the floor contacting member through a gap formed by the two end sections. After the device is engaged and in place, the floor contacting member comes in contact with and is gripped by one or two longitudinal strip contacting surfaces of the generic foot device which cooperates to provide a inside diameter for the device which is smaller than the outside diameter of the floor contacting member. Each such longitudinal strip contacting surface is a part of a longitudinal strip integrally located on inner surface of the protective foot device protruding radially inwardly from the inner surface of the body portion. The body portion of the generic foot device is larger than said contacting furniture member and has both an inner surface and an outer surface. It is this outer surface of the body portion that comes in contact with the floor or the supporting structure. The device is removed from a floor contacting member of the furniture by pulling the member through and out of the gap formed by the two end sections of the protective foot device. The device must be constructed from materials with at least two densities, wherein the longitudinal strips are relatively soft compared to the outer surface.

At the time the original invention was made and until after the latest co-pending application, Ser. No. 506,440 was filed, the applicant believed that a plurality of longitudinally extending strips were preferred, such as illustrated in FIGS. 2 and 3 in this the co-pending application. However, when the device illustrated in FIGS. 2 and 3 were used they failed by cracking within very short periods of time. Generally, within a few weeks to a few months, pieces failed and almost always at a juncture between the two types of plastic.

DETAILED DESCRIPTION

Figure 1:
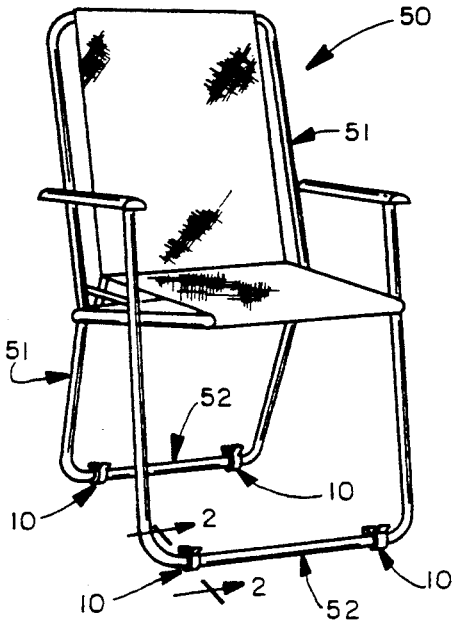
FIG. 1 is a perspective view of a piece of furniture, a chair, having a plurality of the generic protective foot devices made in accordance with the present invention mounted thereon.

FIG. 1 shows a chair having a plurality of protective foot devices 10 for mounting on furniture. Although one particular chair is shown, it is understood that the present invention is not limited to such a chair or even to furniture. Indeed, the present invention can be used with and adopted for many types of weighty objects that come in contact with a floor or similar supporting surface. The embodiment discussed herein is particularly suited for furniture, such as boat chairs, patio chairs, pool chairs, or beach chairs, designed for sitting upright, for adjusting, or for lounging which have at least one floor contacting member. The embodiment discussed herein is also suited for other contacting members such as rod shaped wrought iron patio furniture. The contacting member need not necessarily be a floor contacting member but can be similarly shaped members that do not contact the floor, like an arm support for a chair where a cushioning or padding effect is desired.

Specifically, FIG. 1 shows an upright tubular metal frame chair 50 having a tubular frame 51. Such frame is typically stainless steel, plated steel, or aluminum. Protective foot devices 10 are mounted axially onto the floor contacting members 52. In the present figure, the floor contacting member 52 is a section of the tubular frame 51 that would touch the floor is no devices 10 were mounted thereon. It should be understood that the floor contacting member 52 can be constructed out of many materials, in addition to stainless steel or chrome-plated steel, and can have different shapes, other than tubular.

Figure 2:
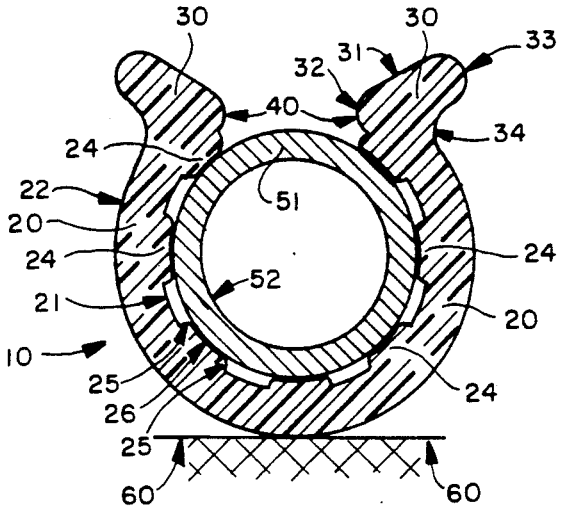
FIG. 2 is a cross-sectional view taken along line 2—2 of FIG. 1 of a protective foot device made in accordance with the present invention and of the contacting member.
Figure 3:
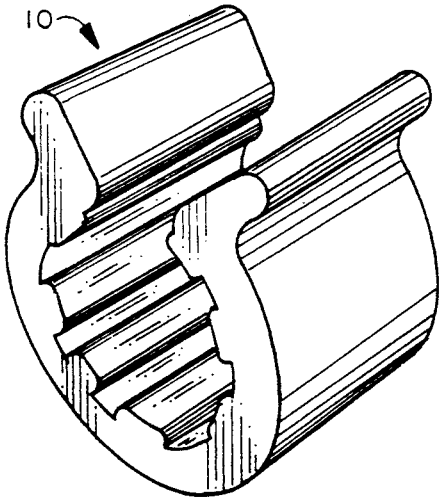
FIG. 3 is a perspective view of a protective foot device made in accordance with the present invention.

Referring specifically to the device of the present invention, FIG. 2 shows a cross-sectional view along line 2—2 of FIG. 1 of a protective foot device 10 and the contacting member 52. Additionally, FIG. 3 is a perspective view of the device 10. The device 10 is placed around the contacting member 52. It is mounted axially to such member 52. In place, the device 10 is situated so that it is interposed between the contacting member 52 and the floor or supporting surface 60. When properly placed on an article of furniture, device 10 can prevent the furniture, or more particularly, any contacting member 52, from coming in direct contact with the floor or supporting surface.

The unitary, protective, generic foot device 10 of this invention has a body portion 20 which is larger than the contacting member 52 so that the device 10 can fit on such member 52. The body portion 20 has both an inner surface 21 and an outer surface 22. It is preferable that both the inner surface 21 and the outer surface 22 roughly follow the contour of the contacting member 52. In the shown embodiment, the outer surface 22 is rounded and continuous in nature and the contacting member 52 is tubular. It is understood that the outer surface 22 can take other shapes (i.e. it might be flatter at the bottom to more appropriately follow the shape of the ground surface 60 besides being rounded but such is not necessary. It is the outer surface 22, that comes in contact with the floor 60. 1 Both inner surface 21 and outer surface 22 extend axially on said body 20.

Figure 4:
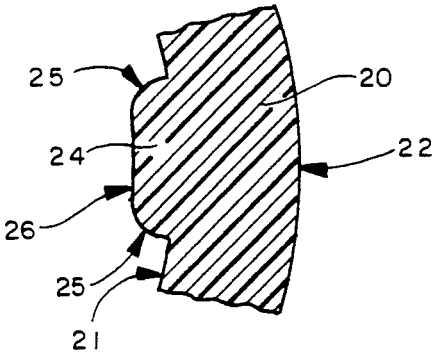
FIG. 4 is a cross-sectional view of a single longitudinal strip and a part of the body portion showing one embodiment of the longitudinal strip.

The device 10 further has a plurality of longitudinal strips 24 protruding radially inwardly from said body portion inner surface 21. Each said longitudinal strip 24 has side surfaces 25 on the sides and a longitudinal strip contacting surface 26. (FIG. 4) Each such longitudinal strip 24, including its side surfaces 25 and longitudinal strip contacting surface 26, extend axially or longitudinally on the inner surface 21. Each such longitudinal strip 24 can also be the same size. It is the longitudinal strip contacting surface 26 of each longitudinal strip 24 that communicates with and comes in contact with the contacting member 52 and grips such member 52.

Figure 8:
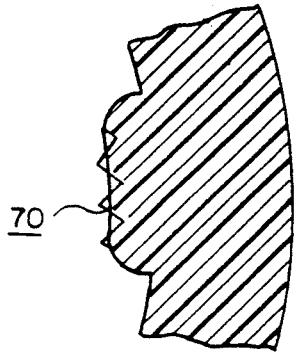
FIG. 8 is a cross-sectional view of a single longitudinal strip having serrations and a part of the body portion showing one embodiment of the longitudinal strip.

The longitudinal strip contacting surface 26 can be flat or curved. Additionally, it can be smooth or rough. For example, the surface 26 can have serrations or gradings (FIG. 8, reference numeral 70) to enhance its grip. Moreover, each such longitudinal strip 24, including longitudinal strip contacting surface 26, can be continuous in the axial or longitudinal direction of the body portion 20 or discontinuous and spaced apart in the axial or longitudinal direction of the body portion 20 so long as the contacting surface 26 of the body portion can frictionally grip the external surfaces of the floor contacting surface of the furniture item.

The protective device of this invention does not require or provide a special foot or finger structure to seat into a slot, aperture or indentations of furniture designed to receive such special foot device projections.

Figure 5:
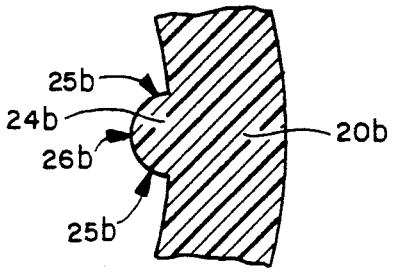
FIG. 5 is a cross-section view of a single longitudinal strip and a part of the body portion showing another embodiment of the longitudinal strip.

It is understood that it is not necessary for the side surfaces 25 to be discontinuous with the longitudinal strip contacting surface 26. As showing in FIG. 4, the side surfaces 25 can be rounded. Such surfaces 25 can also be flat. Additionally, in FIG. 4, the longitudinal strip contacting surface 26 can be concave. FIG. 5 further shows a cross-sectional view of a single longitudinal strip 24*b* and a part of the body portion 20*b*. In this construction, the side surfaces 25*b* curve inwardly towards the longitudinal strip contacting surface 26*b*. Such surfaces are continuous in nature with each other and lack any corners or edges between them. In this embodiment the longitudinal strip contacting surface 26*b* is convex.

The number of and the specific size of the body portion longitudinal strips 24 was previously thought to be entirely dependent on the amount of resistance to movement that may be required. The previously preferred construction shown has seven longitudinal strips 24, with the center of each longitudinal strip approximately 45 degrees apart. It has been found that a foot will work (i.e. have sufficient resistance of movement under normal use) having between 5 and 7 longitudinal strips.

The device 10 further has an end section 30 at each end of the body portion 20. Both end sections 30 define a gap 40 to permit the floor contacting member 52 to pass therethrough. In this manner, the foot device 10 can be mounted by pushing by hand the contacting member 52 between end sections 30 and through gap 40 onto the longitudinal strip contacting surfaces 26 of the longitudinal strips 24. As the member 52 is pushed between the end sections 30, the gap 40 will expand outwardly slightly to accommodate. The gap 40 will usually contact inwardly when the longitudinal strip contacting surfaces 26 of the longitudinal strips 24 grip the member 52. In short, the device 10 can be snapped onto the member 52.

Similarly, the foot device 10 can be removed by pulling the contacting member 52 with the hand between end sections 30 and through the gap 40. And, as the member 52 is pulled between the end sections 30, the gap 40 will expand outwardly slightly to accommodate. The gap 40 will usually contract after the member 52 has been removed from the device 10.

It has been found that an end section having an outwardly extending surface 31, inner-most rounded surface 32, outer-most rounded surface 33, and concave surface 34 connected to and adjacent to said outer surface 22 works best and can simplify the mounted and removal of the device 10 from the contacting members 52. Additionally, should the foot device 10 rotate on contacting member 52, the outer most rounded surface 33 would contact the floor 60 and prevent further rotation of the device.

The device 10 can be a unitary apparatus. A rigid material can be used to make it. Such a material is most durable and will not mar the surface against which it rests. However, unless specifically designed interlocking members (for example, the device disclosed in U.S. Pat. No. 2,888,775) are used or unless a rivet screw or some other type of adhesive/fastener is used, the device is more apt to slip on the contacting member due to a poor grip.

Softer material, which might grip by friction, can also be used to make to device 10. Such a material would eliminate the need for interlocking components or adhesives but could easily scuff or mar a floor, and when used on concrete wear rapidly. In addition, some materials may be too soft to retain their shape and be unsuitable for use as a protective device.

The illustrated embodiment has been constructed to join two different density materials together in a unitary device by coextrusion. The particular manufacturing process is known as dual durometer extrusion which combines two densities (or hardnesses) of synthetic material in a single extrusion in such a manner that the two different density materials are made as a single unit rather than being artificially joined together. Typical types of material used in this process include vinyl, polyurethane and polyvinylchloride (PVC) resin materials. In this manner, the longitudinal strips 24 can be made soft enough to grip the contacting member 52 and to provide adequate friction to prevent slippage or movement. These longitudinal strips 24 can thus have a high friction co-efficient to prevent such movement. Additionally, this soft material typically does not retain its shape and has very little resistance to abrasion or wear. The harder body portion 20, to which the softer material is permanently attached, is formed as a single unit so that the body portion 20 holds the softer strips 24 against the contacting member 52 while at the same time provides resistance to wear. Thus, the body 20 can be made of resilient, high memory synthetic material, such as vinyl or PVC, that will hold the longitudinal strip contacting surfaces 26 against the contacting member 52 with sufficient force to prevent movement of the body 20 along the member 52 and provide a resilient but dense intermediate pad. The external portion of device 10 should be constructed of a harder or denser material to provide a gliding surface when required; it can also be a softer, higher friction material that can retard movement of the furniture.

The actual grade and type of material used depends upon the needs. In one embodiment, the materials used had high resistance to decomposition or breakdown because of the exposure to ultraviolet (U.V.) light and weather. For that reason, they were particularly well adapted to outdoor exposure. In applications where outdoor exposure is not a problem, other grades and types of material can be used depending on color and work characteristics desired including, but not limited to, the amount of friction desired of the outer surface 22, strength of the grip and color. The harder material for the body 20 can be semi-rigid so that it expands enough to be able to allow the throat (gap 40) of the device 10 to open around the receiving member and to return to its original shape.

It has been found that a body made of rigid PVC, B. F. Goodrich GEON® 87416 Durometer (D78) and longitudinal strips made of flexible PVC, B. F. Goodrich GEON 83741 Durometer 70A is a preferred combination of materials for making these protective foot devices. Another combination of material subsequently tested, has improved the gripping aspect of this product and at this time is preferred. This combination is a body of rigid PVC, B. F. Goodrich Geon 87256 durometer D74 with longitudinal strips of flexible PVC, B. F. Goodrich Geon 83741 durometer 70A.

Further, it has been found that the device 10 can have a single longitudinal strip 24 protruding radially inwardly from said inner surface 21, instead of having a plurality of strips 24. Still further, it has been found that smaller strips 24 may peel off from inner surface 21 under severe pressure. This has been alleviated by either extending the size of the strip 24 in the extrusion process or, if a smaller strip 24 is desired, partially embedding the strip 24 deeper into the body portion 20. This is specifically shown in FIGS. 6 and 7. The hard (region B) and soft (region A) sections are formed as a single unit and not joined by an adhesive.

Figure 6:
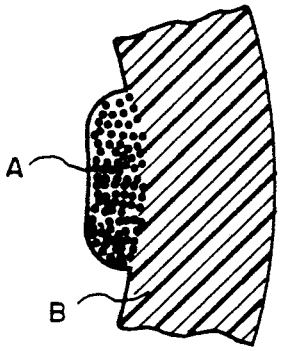
FIG. 6 is a cross-sectional view of single longitudinal strip and a body portion specifically showing one arrangement of the two densities of material.
Figure 7:
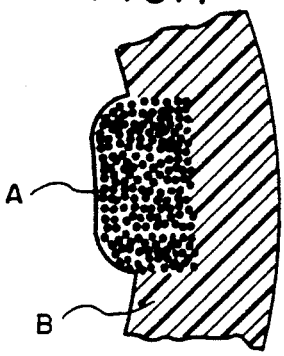
FIG. 7 is a cross-sectional view of a single longitudinal strip and a body portion specifically showing another arrangement of the two densities of material.

In particular, FIG. 6 shows a cross-sectional view of single longitudinal strip 24 and a body portion 20 having durometers, with one density being limited to the strip 24 (shown as region A) and the other density being limited to the rest of the device 10 (shown as region B). FIG. 7 shows a cross-sectional view of a strip 24 and a body 20 having durometers, with one density (region A) extending deeper into body portion 20.

The device 10 can be made in a variety of shapes that can snap onto a variety of corresponding longitudinal shapes that have a similar cross section. It can then serve as an "anchor" or interconnecting member with a high resistance to movement that will hold other devices to that longitudinal shape. For example, an ashtray or a drink holder can be connected to device 10 by connection means and the device can be attached to a vertical chair arm. Thus, the device 10 can also provide a much easier way of attaching these conveniences, or other similar conveniences, to any type of tubing or rod furniture. The strength of the attachment can be increased as needed by widening the longitudinal strips 24 or by lengthening the longitudinal strip 24 itself, since it could be cut or made at any length desired.

Figure 9:
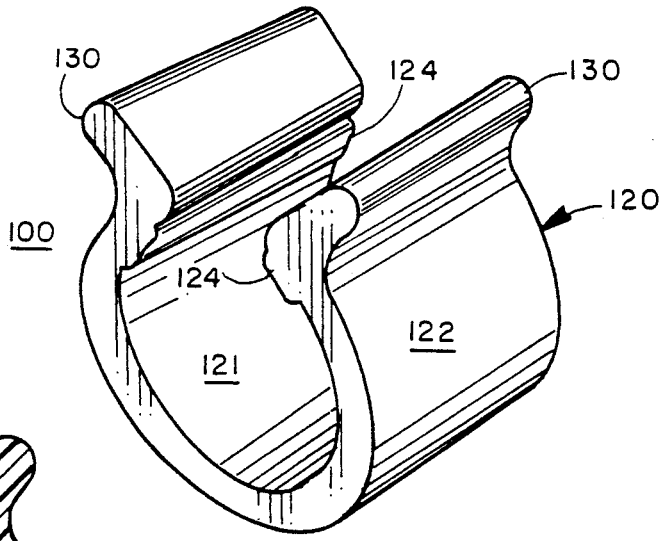
FIG. 9 is a perspective view of the preferred embodiment of the invention.
Figure 10:
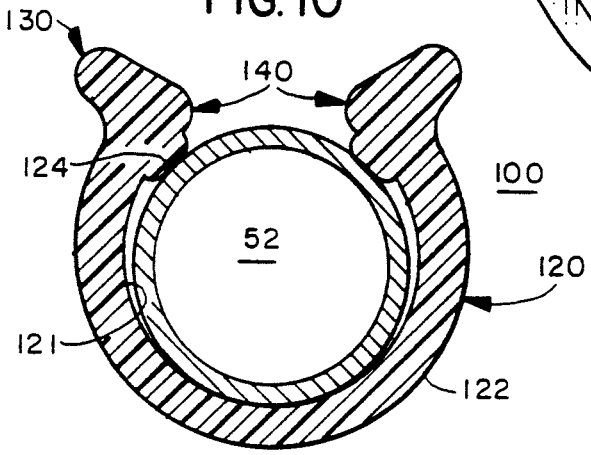
FIG. 10 is a cross-sectional view like FIG. 2 but with the preferred embodiment of FIG. 9.

In connection with the newly discovered preferred embodiment illustrated in FIGS. 9 and 10, a device 100 made of the same materials as the device 10 and has a body portion 120 having an inner surface 121 and an outer surface 122, the body portion 120 being generally cylindrical in shape having end sections 130 forming an axially extending gap 140. The device 100 operates exactly as device 10; however, the location of strips 124 are different and limited to one or two strips, each close to an outwardly extending end section 130. As is shown, the end sections 130 each have an area where the plastic; material is thicker than the body portion 120, and it is preferred that at least part of strip 124 is in registry with a part of the thicker end section 130. Although one strip 124 will provide resistance to axial or rotational movement of the device 110 with respect to the tubular member 52, it is preferred that two strips 124 be employed, one close to each end section 130.

In the preferred embodiment, the outside diameter of tubular member 52 is the same as the inside diameter of the body portion 120. The thickness of each strip 124 is about 25–30/1000 of an inch and two such strips in use result in an inside diameter of the device 110 with two strips 124 being 50–60/1000 of an inch smaller than the outside diameter of tubular member 52. The difference in diameters between member 52 and device 110 results in device 110 always being in stress when mounted on member 52. It is believed that this stress combined with migration of one plastic into another results in the cracking heretofore encountered. It is further believed that this stress results in crystallization of the plastic at the juncture between the softer and harder plastics in the areas of greatest stress. It also has been found that best results occur when thickness of the body portion 120 is uniform.

Although a preferred embodiment has been disclosed herein, minor variation, changes and modifications may be made therein without departing from the scope and spirit of the invention.

I claim:

1. A dual durometer protective foot device for axially mounting on a tubular floor contacting member of a piece of furniture, said foot device comprising: a generally cylindrically shaped body portion of a first durometer material having an inner surface and terminating in two end sections defining an axially extending gap, and a second durometer material extending inwardly from the inner surface of said first durometer material and having an inner diameter slightly smaller than the outer diameter of the tubular floor contacting member, said second durometer material restricting rotational and axial movement of said foot device with respect to the floor contacting member when said foot device is mounted thereon, said second durometer material only being positioned close to one of said end sections such that stress in said body portion due to deformation thereof when mounted on the tubular floor contacting member does not crack said body portion causing failure thereof.

2. The dual durometer protective foot device of claim 1, wherein the second durometer material is in the form of a longitudinally extending strip.

3. The dual durometer protective foot device of claim 2, wherein there are two strips of second durometer material each integral with said body portion, each positioned close to one of said end sections.

4. The dual durometer protective foot device of claim 1, wherein said first durometer material is harder than said second durometer material.

5. The dual durometer protective foot device of claim 3, wherein each strip is continuous in the longitudinal direction thereof.

6. The dual durometer protective foot device of claim 3, wherein the strip surface in contact with the floor contacting member is smooth.

7. The dual durometer protective foot device of claim 3, wherein the strip surface in contact with the floor contacting member is rough.

8. The dual durometer protective foot device of claim 3, wherein the strip surface in contact with the floor contacting member has serrations.

9. The dual durometer protective foot device of claim 3, wherein each end section has an outwardly extending thicker portion for aiding in the mounting and removal of said device from the tubular member and for limiting rotation of said device with respect to the member.

10. The dual durometer protective foot device of claim 1, wherein said body portion has a uniform thickness between said end sections.

11. A dual durometer protective foot device for axially mounting on a tubular floor contacting member of a piece of furniture, said foot device comprising: a generally cylindrically shaped body portion of a first durometer material having an inner surface and terminating in two end sections defining an axially extending gap, said inner surface having an inner diameter of said body portion substantially the same as the outer diameter of the tubular floor contacting member, each end section having an outwardly extending portion for assisting in the mounting and removing of said device from the tubular member and for limiting rotation of said device with respect to the tubular member, two longitudinally extending strips of a second durometer material integral with said body portion extending radially inwardly from said inner surface restricting rotational and axial movement of said foot device with respect to the floor contacting member when said foot device is mounted thereon, each of said strips being positioned close to one of said end sections such that stress in said body portion due to deformation thereof when mounted on the tubular floor contacting member does not crack said body portion causing failure thereof.

12. The dual durometer protective foot device of claim 11, wherein said body portion is PVC having a durometer not less than about D70.

13. The dual durometer protective foot device of claim 12, wherein said body portion has a durometer not less than in the range of from about D70 to about D80.

14. The dual durometer protective foot device of claim 11, wherein said strips are PVC having a durometer of about 70A.

15. The dual durometer protective foot device of claim 12, wherein said body portion has a durometer not less than in the range of from about D70 to about D80 and said strips are PVC having a durometer of about 70A.

16. In combination, a piece of furniture having a seat and a frame including a tubular floor contacting member, a dual durometer protective foot device axially mounted on said tubular floor contacting member, said dual durometer foot device including a generally cylindrically shaped body portion of a first durometer material having an inner surface and terminating in two end sections defining an axially extending gap, said end sections being thicker than said body portion, and a second durometer material extending inwardly from the inner surface of said first durometer material and having an inner diameter slightly smaller than the outer diameter of the tubular floor contacting member, said second durometer material restricting rotational and axial movement of said foot device with respect to the floor contacting member when said foot device is mounted thereon, said second durometer material only being positioned close to one of said end sections such that stress in said body portion due to deformation thereof when mounted on the tubular floor contacting member does not crack said body portion causing failure thereof.

17. The combination of claim 16, wherein the furniture is a chair and the second durometer material is in the form of a longitudinally extending strip.

18. The combination of claim 17, wherein the second durometer material is in the form of two longitudinally extending strips each integral with said body portion.

19. The combination of claim 18, wherein each end section has an outwardly extending portion for aiding in the mounting and removal of said device from the tubular member and for limiting rotation of said device with respect to the member.

20. The combination of claim 18, wherein said body portion is PVC and has a durometer not less than in the range of from about D70 to about D80 and said strips are PVC having a durometer of about 70A.

* * * * *